US006652268B1

(12) United States Patent
Irwin et al.

(10) Patent No.: US 6,652,268 B1
(45) Date of Patent: Nov. 25, 2003

(54) BURNER ASSEMBLY

(75) Inventors: Bruce C. Irwin, Chattanooga, TN (US); Russell Fountain, Chattanooga, TN (US); Malcolm Swanson, Chattanooga, TN (US); Joseph Unjakoti, Chattanooga, TN (US); Michael Swanson, Chattanooga, TN (US)

(73) Assignee: Astec, Inc., Chattanooga, TN (US)

( * ) Notice: Subject to any disclaimer, the term of this patent is extended or adjusted under 35 U.S.C. 154(b) by 0 days.

(21) Appl. No.: 10/356,288

(22) Filed: Jan. 31, 2003

(51) Int. Cl.[7] ..... F23Q 9/00

(52) U.S. Cl. ..... 431/284; 431/115; 431/182; 431/188; 431/285

(58) Field of Search ..... 431/284, 285, 431/187, 182, 181, 278, 9, 10, 184, 183, 115, 188

(56) References Cited

U.S. PATENT DOCUMENTS

| | | | | |
|---|---|---|---|---|
| 1,676,813 A | | 7/1928 | Atwater | |
| 1,754,751 A | | 4/1930 | Grayson et al. | |
| 2,364,704 A | | 12/1944 | Franz | |
| 2,840,152 A | | 6/1958 | Reed | |
| 2,960,275 A | | 11/1960 | Wolf | |
| 3,659,962 A | | 5/1972 | Zink et al. | |
| 3,817,695 A | | 6/1974 | Reed et al. | |
| 4,113,289 A | | 9/1978 | Wagner et al. | |
| 4,226,087 A | | 10/1980 | Spadaccini | |
| 4,457,704 A | | 7/1984 | Sommers et al. | |
| 4,464,110 A | | 8/1984 | Boden et al. | |
| 4,585,410 A | | 4/1986 | Baker et al. | |
| 5,192,204 A | * | 3/1993 | Musil | 431/10 |
| 5,464,344 A | | 11/1995 | Hufton | |
| 5,511,970 A | * | 4/1996 | Irwin et al. | 431/9 |
| 5,573,396 A | * | 11/1996 | Swanson | 432/106 |
| 5,700,143 A | * | 12/1997 | Irwin et al. | 431/284 |
| 5,807,094 A | * | 9/1998 | Sarv | 431/177 |
| ,041,316 A1 | | 11/2001 | Haynes et al. | |
| 6,488,496 B1 | | 12/2002 | Feese et al. | |

FOREIGN PATENT DOCUMENTS

JP 404073502 A 3/1992

* cited by examiner

*Primary Examiner*—James C. Yeung
(74) *Attorney, Agent, or Firm*—Chambliss, Bahner & Stophel, P.C.

(57) ABSTRACT

A burner assembly including a housing having an air inlet and a burner end. An impeller that is mounted in the housing is in communication with the air inlet and adapted to direct air toward the burner end of the housing. The burner assembly also includes an inner air tube that is mounted in the burner end of the housing so as to define an inner combustion zone and an outer combustion zone. The assembly further includes a plurality of radiation plates that are mounted in the burner end of the housing adjacent to the outer combustion zone, an inner air spin vane that is mounted on the inner air tube so as to direct some of the air from the impeller into the inner combustion zone, an inner gas injection nozzle mounted on the inner air tube so as to direct gaseous fuel into the inner combustion zone, an outer air spin vane that is mounted in the burner end of the housing so as to direct some of the air from the impeller into the outer combustion zone, and a plurality of outer gas injection nozzles that are mounted in the burner end of the housing so as to direct gaseous fuel into the outer combustion zone. A first castellated ring is mounted around the periphery of the inner air tube, and a second castellated ring is mounted around the periphery of the burner end of the housing.

20 Claims, 10 Drawing Sheets

BURNER ASSEMBLY

FIELD OF THE INVENTION

This invention relates generally to an improved burner assembly, and more particularly, to an improved fuel burner assembly for heating and drying aggregate materials used in connection with the production of hot mix asphalt.

BACKGROUND AND DESCRIPTION OF THE PRIOR ART

It is known to use a fuel burner assembly to heat and dry aggregate materials used in connection with the production of hot mix asphalt. See, e.g., U.S. Pat. Nos. 5,700,143; 5,511,970; 4,559,009; and 4,298,337. However, conventional burner assemblies suffer from several disadvantages. For example, conventional burner assemblies are incapable of producing a flame configuration satisfactory for asphalt production in a variety of different-sized combustion chambers. As a result, burner assemblies typically include adjustable spin vanes to accommodate different-sized combustion chambers. For example, U.S. Pat. No. 6,488,496 of Feese et al. describes a compact combination burner with an adjustable spin rack. Adjustable spin vanes, however, increase the cost of manufacture, the likelihood of repair, and the amount of labor required to operate the burner.

In addition, burner assemblies having castellated elements are known and disclosed by U.S. Pat. Nos. 2,840,152 and 1,676,813. These burner assemblies, however, do not utilize the castellated elements to maximum advantage. It would be desirable, therefore, if an apparatus could be provided that could be used to produce a stable flame configuration that has a short flame length and a narrow flame diameter adapted for use on a wide variety of different-sized combustion chambers. It would also be desirable if such an apparatus could be provided that would more completely and evenly mix fuel and air in order to obtain more rapid combustion, thereby reducing the combustion space required in the asphalt drum and lowering carbon monoxide (CO) emissions in the combustion space. It would be further desirable if such an apparatus could be provided that would reduce the temperature of the dryer drum breech plate where the burner is mounted. It would be still further desirable if such an apparatus could be provided that would eliminate the need to adjust spin vanes to achieve a desired flame configuration. It would be still further desirable if such an apparatus could be provided that would achieve reduced nitrous oxide (NOx) emissions. It would also be desirable if such an apparatus could be provided that would be less complicated and expensive to manufacture, operate and maintain.

ADVANTAGES OF THE INVENTION

Accordingly, it is an advantage of the invention claimed herein to provide an apparatus for producing a stable flame configuration that has a short flame length and a narrow flame diameter. It is also an advantage of the invention to provide an apparatus for producing a flame configuration that is adapted for use on a wide variety of different-sized combustion chambers having different-sized combustion spaces. It is another advantage of the invention to provide an apparatus that more rapidly, completely, and evenly mixes fuel and air, thereby improving combustion intensity, reducing the combustion space required in the asphalt drum, and reducing CO emissions in the combustion space. It is still another advantage of the invention to provide an apparatus that reduces the temperature of the dryer drum breech plate. It is yet another advantage of a preferred embodiment of the invention to provide an apparatus that achieves reduced NOx emissions. It is a further advantage of the invention to provide an apparatus that eliminates the need for adjustable spin vanes in order to achieve a desired flame configuration. It is a still further advantage of the invention to provide an apparatus that is less complicated and expensive to manufacture, operate and maintain than conventional burner assemblies.

Additional advantages of the invention will become apparent from an examination of the drawings and the ensuing description.

EXPLANATION OF TECHNICAL TERMS

As used herein, the term castellated ring refers to both an integral, contiguous ring having two effective diameters produced by castellated and non-castellated portions of the ring. In addition, the term castellated ring also refers to a plurality of castellations mounted in a spaced apart relationship to each other around an annular channel, air tube, opening or the like so as to produce two effective diameters in the annular channel, air tube, opening or the like.

As used herein, the terms total open area of the burner end or total open area of the burner end of the housing refer to the cross-sectional area of the burner end of the housing. More particularly, the terms total open area of the burner end or total open area of the burner end of the housing refer to the cross-sectional area defined on its outer perimeter by the housing.

As used herein, the terms low fire or firing on low fire refer to a nominal or minimal burner firing rate. More particularly, the terms low fire or firing on low fire refer to a firing rate of at least one-seventh of the total fuel and air input rate of the burner assembly.

SUMMARY OF THE INVENTION

The invention comprises a burner assembly including a housing having an air inlet and a burner end. An impeller that is mounted in the housing is in communication with the air inlet and adapted to direct air toward the burner end of the housing. The burner assembly also includes an inner air tube that is mounted in the burner end of the housing so as to define an inner combustion zone and an outer combustion zone. The assembly further includes a plurality of radiation plates that are mounted in the burner end of the housing adjacent to the outer combustion zone, an inner air spin vane that is mounted on the inner air tube so as to direct some of the air from the impeller into the inner combustion zone, an inner gas injection nozzle mounted on the inner air tube so as to direct gaseous fuel into the inner combustion zone, an outer air spin vane that is mounted in the burner end of the housing so as to direct some of the air from the impeller into the outer combustion zone, and a plurality of outer gas injection nozzles that are mounted in the burner end of the housing so as to direct gaseous fuel into the outer combustion zone. A first castellated ring is mounted around the periphery of the inner air tube, and a second castellated ring is mounted around the periphery of the burner end of the housing. The burner assembly also includes an igniter that is mounted in the burner end of the housing.

In a preferred embodiment, a liquid fuel system is provided in the burner end of the housing. In this preferred embodiment, an atomizing air tube is mounted within the housing. The atomizing air tube has an inlet end located downstream of the impeller and an outlet end located adjacent to the inner combustion zone. Also in this preferred embodiment, an atomizing nozzle is mounted on the outlet end of the atomizing air tube, a liquid fuel supply tube is mounted within the atomizing air tube so as to convey liquid fuel to the atomizing nozzle, a compressed air supply tube is mounted within the atomizing air tube so as to convey compressed air to the atomizing nozzle, and a third castellated ring is mounted around the periphery of the outlet end of the atomizing air tube.

In another preferred embodiment, a supplemental natural gas injection system is provided in the burner end of the housing. The supplemental natural gas injection system includes a premix natural gas nozzle, a natural gas manifold in fluid communication with the premix natural gas nozzle, a means for mixing combustion air and natural gas, and a plate mounted on the inner air tube. The plate includes a heat fin and an outer air castellated flame holder cup. In this preferred embodiment, a diverging conical discharge section is located downstream from the converging focusing cone and an adjustable opening band is mounted between the diverging conical discharge section and the converging focusing cone.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
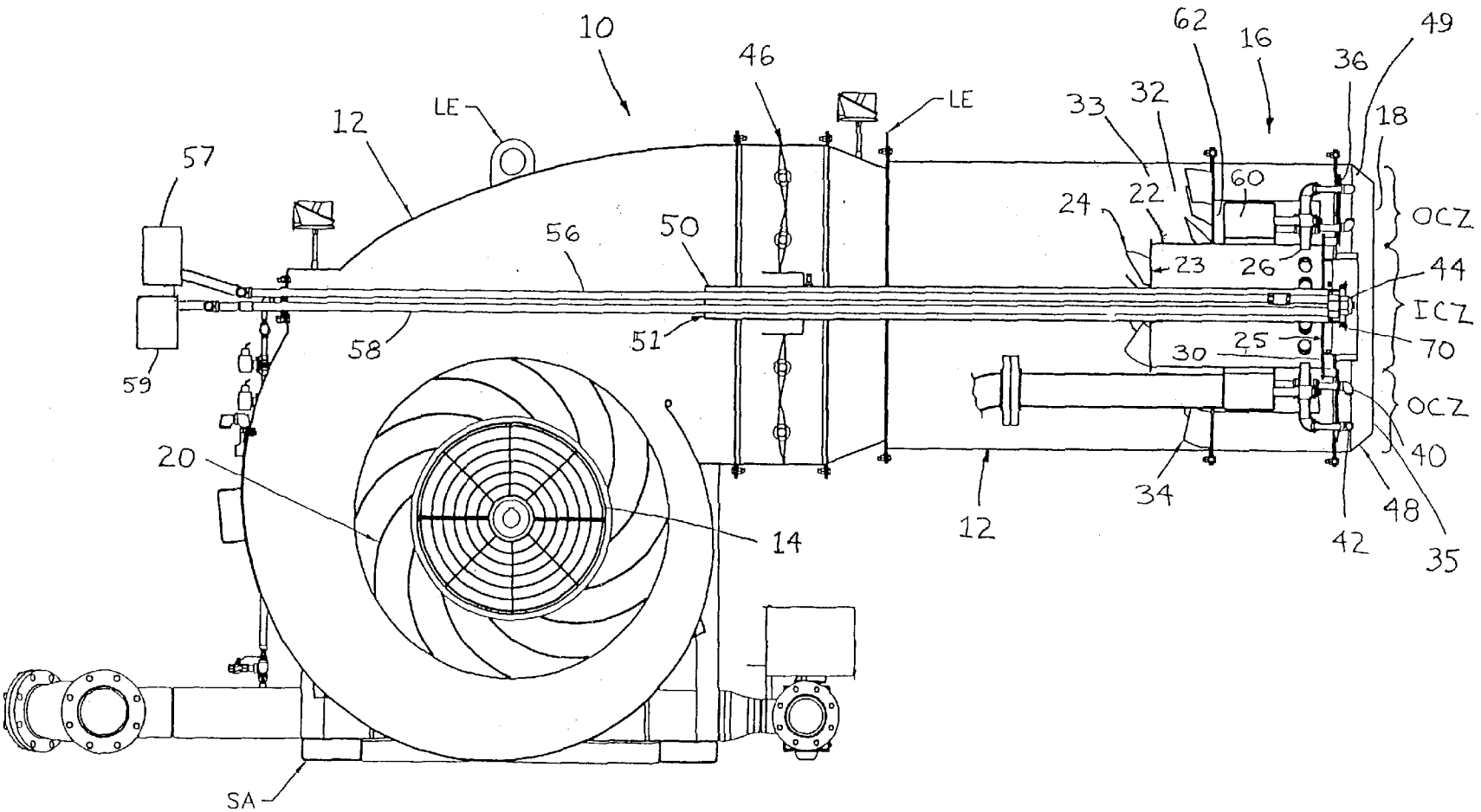
FIG. 1 is a partial sectional side view of a preferred embodiment of the burner assembly in accordance with the present invention.

Referring now to the drawings, the apparatus of the invention claimed herein is illustrated by FIGS. 1 through 11. FIG. 1 illustrates a preferred embodiment of the burner assembly in accordance with the present invention. The burner assembly is designated generally by reference numeral 10. Burner assembly 10 is built on skid assembly SA having lifting eyes LE that allow the assembly to be handled with a fork truck or hoist. The preferred burner assembly is adapted to selectively fire on a gaseous fuel such as natural gas or a liquid fuel such as fuel oil, or both.

As shown in FIG. 1, burner assembly 10 comprises housing 12 having air inlet 14 and burner end 16 downstream from the air inlet. Housing 12 generally contains the working components of the burner assembly and provides an outer shell within which combustion air may be pressurized, conveyed from the air inlet to the burner end, and mixed with fuel to produce a flame at the burner end of the housing. Air inlet 14 is adapted to supply air to the burner assembly. Burner end 16 is the area where fuel and air are mixed into a combustible mixture. The burner end is provided with opening 18 through which a flame is developed and burned.

Housing 12 also contains impeller 20 which is mounted upstream from the burner end of the housing and is in communication with the air inlet. Impeller 20 is adapted to pressurize air supplied by the air inlet and convey the pressurized air downstream towards the burner end of the housing. Impeller 20 promotes high combustion air exit velocities and rapid mixing for higher combustion intensity. Impeller 20 may be a backward curved impeller or any other suitable device for pressurizing air and conveying pressurized air. While FIG. 1 illustrates a preferred configuration for housing 12, it is understood that housing 12 may be of any suitable conventional configuration. It is also contemplated within the scope of the invention that housing 12 may be either an integral structure or a modular structure comprising two or more separable components.

As shown in FIG. 1, housing 12 also includes inner air tube 22. Some of the pressurized combustion air produced by impeller 20 enters upstream end 23 of inner air tube 22 after passing through inner air spin vane 24. Thereafter, the combustion air exits the inner air tube through downstream end 25. Inner air tube 22 is mounted in the burner end of the housing and defines inner combustion zone ICZ and concentric outer combustion zone OCZ. Inner air spin vane 24 is mounted on the inner air tube so as to direct some of the combustion air from the impeller into the inner combustion zone. Inner air spin vane 24 adds to the swirling flow of the air within the inner air tube. Inner air spin vane 24 is fixed and therefore does not require adjustment. Inner air tube 22 also includes one or more inner gas injection nozzles 26 which are mounted on the inner air tube so as to direct gaseous fuel into the inner combustion zone. In addition, inner gas injection nozzles contribute to the combustion characteristics that are developed in flame recirculation zone RZ (See FIGS. 4 and 5). In a preferred embodiment, inner air tube 22 includes longitudinal axis 28 (See FIG. 2) and a plurality of inner gas injection nozzles 26 that are spaced equally around the inner air tube so as to direct gaseous fuel into the inner air tube.

Figure 2:
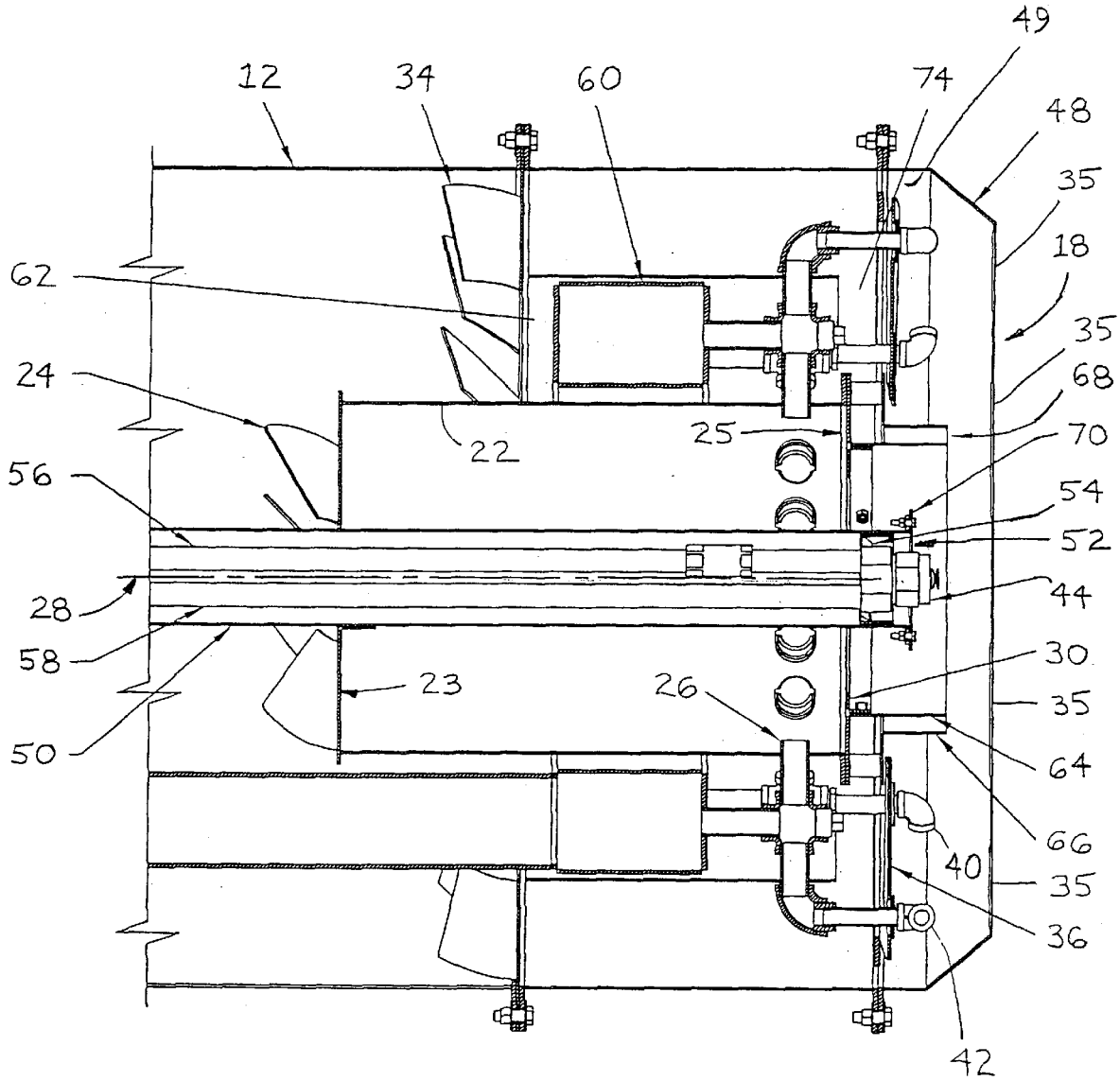
FIG. 2 is an enlarged sectional side view of the burner end of the burner assembly shown in FIG. 1.
Figure 6:
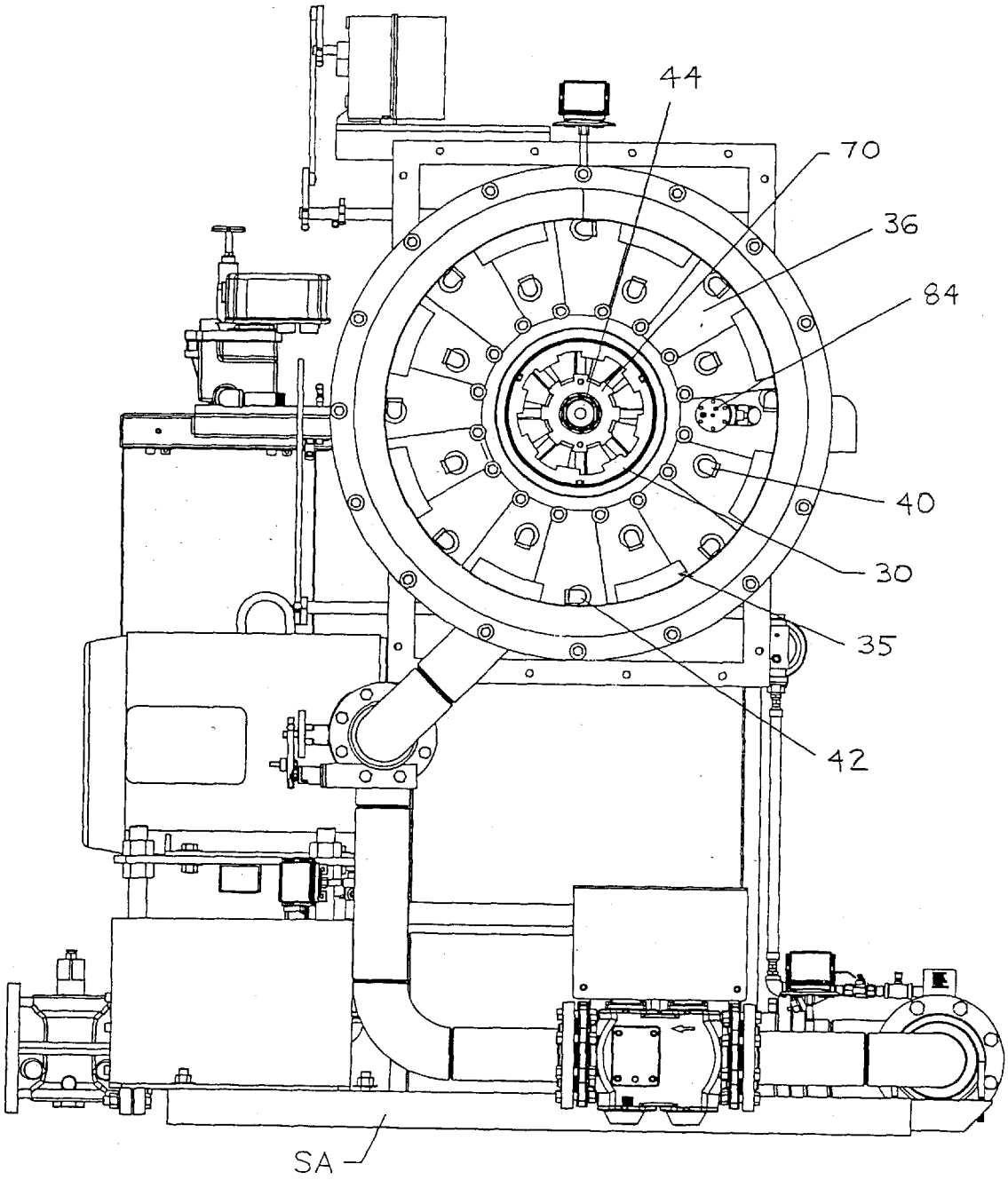
FIG. 6 is an end view of the burner assembly shown in FIG. 1.

As shown in FIGS. 1, 2 and 6, preferred first castellated ring 30 is mounted around the periphery of downstream end 25 of inner air tube 22. Ring 30 is adapted to direct some of the combustion air in the inner air tube, thereby squeezing the flame into a narrow configuration through the use of the alternating effective diameters of the ring. First castellated ring 30 is a ring having two different effective diameters, although it is contemplated within the scope of the invention that the first castellated ring, as well as the other castellated rings discussed below, may have more than two different effective diameters. As a result of the alternating effective diameters of first castellated ring 30, the single ring simultaneously provides the advantages of two conventional rings having different diameters. More particularly, first castellated ring 30 enhances flame stability and simultaneously produces a short flame length like a conventional ring having a large diameter and reduces the diameter of the flame like a conventional ring having a small diameter. In a preferred embodiment, some of the combustion air that flows past the first castellated ring thereafter flows past third castellated ring 70, which is described in detail below.

Still referring to FIG. 1, housing 12 also includes outer annular channel 32 which is defined by the open space between inner air tube 22 and housing 12. Some of the pressurized combustion air produced by impeller 20 enters intake end 33 of outer annular channel 32 and then flows through outer air spin vane 34. Outer air spin vane 34 is mounted in the burner end of the housing so as to direct some of the air from impeller 20 into outer combustion zone OCZ. Outer air spin vane 34 adds to the swirling flow of air within the outer annular channel. Outer air spin vane 34 is fixed and therefore does not require adjustment. After flowing through the outer air spin vane, combustion air flows downstream through annular channel 32 toward the outer combustion zone by several different paths which will be described in more detail below (See generally FIG. 3).

As shown in FIGS. 1 through 3 and 6, preferred second castellated ring 35, in the form of a plurality of separate castellations, is mounted directly onto the perimeter of the discharge end of converging focusing cone 48. In an alternative preferred embodiment (not shown), an integral, contiguous castellated ring may be mounted around the discharge end of the converging focusing cone or around the periphery of the burner end of the housing. Also in a preferred embodiment, a plurality of separate castellations may be mounted around the periphery of the burner end of the housing. In each preferred embodiment, the castellations around the discharge end of the converging focusing cone are adapted to direct some combustion air toward the center of the burner assembly.

As shown in FIG. 6, second castellated ring 35 is a ring having two different effective diameters. Second castellated ring 35, like first castellated ring 30, squeezes the flame produced by the burner assembly into a narrow configuration through the use of the two alternating effective diameters of the ring. As a result of the alternating effective diameters, second castellated ring 35 simultaneously provides the advantages of two conventional rings having different diameters. More particularly, second castellated ring 35 enhances flame stability and simultaneously produces a short flame length like a conventional ring having a large diameter and a narrow flame diameter like a conventional ring having a small diameter.

As shown in FIGS. 1–3 and 6, burner assembly 10 also includes a plurality of radiation plates 36 that are mounted in the burner end of the housing adjacent to the outer combustion zone. In a preferred embodiment, the radiation plates are mounted in a partially overlapping "fishscale" arrangement such that radiation plate gap 38 is provided between each pair of adjacent radiation plates (See FIG. 3). Each radiation plate gap 38 permits some combustion air from annular channel 32 to flow between each pair of adjacent radiation plates. The radiation plate gaps also add to the swirling flow of the air in the burner end of the housing. In addition, the flow of air through the radiation plate gaps prevents oil spray build-up on the radiation plates. Burner efficiency may be affected by the size of the gaps between each pair of adjacent radiation plates. For example, if the size of the gaps is too small, the radiation plates may become too hot. If, on the other hand, the size of the gaps is too large, the burner flame may not be stable over a wide range of fuel-to-air ratios. In a preferred embodiment, the size of each radiation plate gap 38 is between about 0.125 inches and about 0.1875 inches, and the aggregate open area of all the radiation plate gaps represents between about 5% and about 15% of the total open area of the burner end of the housing.

Referring to FIGS. 1–6, the burner assembly also includes a plurality of outer gas injection nozzles 40 and 42 that are mounted in the burner end of the housing so as to direct gaseous fuel into the outer combustion zone. In a preferred embodiment, a plurality of radiation plate inner gas injection nozzles 40 are mounted through the radiation plates so as to inject gaseous fuel radially outwardly toward the combustion air that is forced toward the center of the burner assembly by second castellated ring 35 (See FIG. 6). As shown in FIG. 6, in a preferred embodiment, each castellated portion of second castellated ring 35 is generally aligned with each radiation plate inner gas injection nozzle 40. Also in a preferred embodiment, a plurality of radiation plate outer gas injection nozzles 42 are mounted through radiation plates 36 and around atomizing nozzle 44 so as to direct gaseous fuel in the general direction of the combustion air directed by outer air spin vane 34. As shown in FIG. 6, in a preferred embodiment, each radiation plate outer gas injection nozzle 42 is located adjacent to a non-castellated portion of second castellated ring 35.

Still referring to FIG. 1, a preferred embodiment of burner assembly 10 includes damper 46 mounted in the housing and adapted to throttle or limit the flow of most of the pressurized combustion air produced by the impeller into and around inner air tube 22. In addition, a preferred burner assembly includes converging focusing cone 48 which is mounted on the burner end of the housing around the periphery of the outer combustion zone. Housing 12, converging focusing cone 48, and radiation plates 36 form annular gap 49 therebetween. Annular gap 49 permits some combustion air from the impeller to flow from the outer annular channel toward the outer combustion zone (See also FIG. 3).

As shown in FIG. 1, in a preferred embodiment of the burner assembly, some of the pressurized combustion air produced by impeller 20 enters atomizing air tube 50 which is mounted within the housing. The atomizing air tube has inlet end 51 and outlet end 52 (See FIG. 2). The inlet end of the atomizing air tube is located downstream of impeller 20 and upstream of damper 46. The outlet end of the atomizing air tube is located adjacent to the inner combustion zone. The combustion air flowing through the atomizing air tube flows through atomizing air spin vane 54 (See FIG. 2) and then past atomizing nozzle 44 which will be described in detail below. As shown in FIG. 2, atomizing air spin vane 54 is mounted in the burner end of the housing and adds to the swirling flow of air around the outlet end of the atomizing air tube. Atomizing air spin vane 54 also directs some of the combustion air from the impeller into the inner combustion zone. Atomizing air spin vane 54 and the overall configuration of the burner assembly enhances the combustion characteristics that are developed in recirculation zone RZ immediately downstream of atomizing nozzle 44 (See FIGS. 4 and 5).

As shown in FIG. 1, in a preferred embodiment of the burner assembly, liquid fuel supply tube 56 is mounted within atomizing air tube 50 so as to convey liquid fuel (such as oil) to atomizing nozzle 44. Compressed air supply tube 58 is mounted within atomizing air tube 50 so as to convey compressed air to atomizing nozzle 44. In another preferred embodiment, means 57 are provided for conveying the liquid fuel through the liquid fuel supply tube at a pressure of between about 55 psi and about 75 psi. Means 57 may be any suitable conventional source for providing liquid fuel under pressure such as a pump and valve arrangement or the like. In yet another preferred embodiment of the invention, means 59 are provided for conveying the compressed air through the compressed air supply tube at a pressure of between about 55 psi and about 75 psi. Means 59 may be any suitable conventional source for providing air under pressure such as a pump and valve arrangement. The combustion air conveyed to the atomizing nozzle by atomizing air tube 50 helps to eliminate large oil droplets or overspray from escaping the flame when the burner assembly is firing with liquid fuel. This air also prevents the oil spray from extending too wide and impinging on barrier air ring 64 (See FIG. 2) at low fire as discussed below.

Referring still to FIG. 1, in a preferred embodiment of the burner assembly, gas manifold 60 is in fluid communication with inner gas injection nozzle 26 and the plurality of outer gas injection nozzles 40 and 42. Also in a preferred embodiment, manifold 60 is mounted downstream of outer air spin vane 34 so that the manifold is cooled by some of the air from the impeller. More particularly, gas manifold 60 is cooled by some of the air that flows through outer air spin vane 34 and into cavity 62 (See also FIG. 2).

Referring now to FIG. 2, a sectional side view of the burner end of the burner assembly shown in FIG. 1 is illustrated. As shown in FIG. 2, in a preferred embodiment, the burner assembly includes barrier air ring 64 and control ring 66 that are mounted in the burner end of the housing. The barrier air ring and the control ring are mounted such that annular barrier air passage 68 is formed therebetween. Some of the combustion air produced by impeller 20 flows through barrier air passage 68. This portion of the combustion air helps to prevent oil spray from atomizing nozzle 44 from extending too wide and impinging upon barrier air ring 64 at low fire. Barrier air passage 68 also prevents low fire oil spray from being drawn into the radiation plates, thereby minimizing carbon and dirt build-up. In another preferred embodiment, barrier air passage 68 comprises between about 15% and about 22% of the total open area of the burner end of the housing. In an alternative embodiment (not shown), the diameter of barrier air ring 64 may be increased to approximately the same diameter as inner air tube 22 such that control ring 66 may be eliminated.

Referring still to FIG. 2, in a preferred embodiment of the burner assembly, atomizing nozzle 44 is mounted on outlet end 52 of atomizing air tube 50. Atomizing nozzle 44 is of the self-recirculating stabilizing type. Also in a preferred embodiment of the invention, third castellated ring 70 is mounted around the periphery of outlet end 52 of atomizing air tube 50. Third castellated ring 70 is adapted to direct some combustion air toward the center of the inner combustion zone. Ring 70 is a ring having two different alternating effective diameters. Third castellated ring 70, like the other two castellated rings described earlier, squeezes the flame into a narrow configuration through the use of the alternating effective diameters of the ring. As a result of the alternating effective diameters, third castellated ring 70 simultaneously provides the advantages of two conventional rings having different diameters. More particularly, third castellated ring 70 enhances flame stability and simultaneously produces a short flame length like a conventional ring having a large diameter and a narrow flame diameter like a conventional ring having a small diameter.

In a preferred embodiment of the burner assembly, first castellated ring 30 has the same number of castellations as third castellated ring 70. Also in a preferred embodiment, the castellations of the third castellated ring are radially outwardly aligned with the non-castellated portions of the first castellated ring. Also in a preferred embodiment, third castellated ring 70 is downstream of first castellated ring 30. In another preferred embodiment, first castellated ring 30 has an inner diameter of approximately 5.5 inches and an outer diameter of approximately 6.5 inches, while third castellated ring 70 has an inner diameter of approximately 9.5 inches and an outer diameter of approximately 10.5 inches. In yet another preferred embodiment, the distance along the longitudinal axis of the inner air tube between the first castellated ring and the second castellated ring is greater than the distance between the third castellated ring and the atomizing nozzle. It is contemplated within the scope of the invention, however, that the number, orientation, and spacing of the first and third castellated ring may be different than previously described.

Also in a preferred embodiment, the combustion air flowing through inner air tube 22 flows past first castellated ring 30 and third castellated ring 70. Thereafter, the combustion air flows into the inner combustion zone inside of barrier air ring 64. The spacing and size of third castellated ring 70 and barrier air ring 64 is important for flame development, especially when firing on oil.

It is preferred that the area between the third castellated ring and the barrier air ring comprises between about 13% and about 22% of the total open area of the burner end of the housing.

Figure 3:
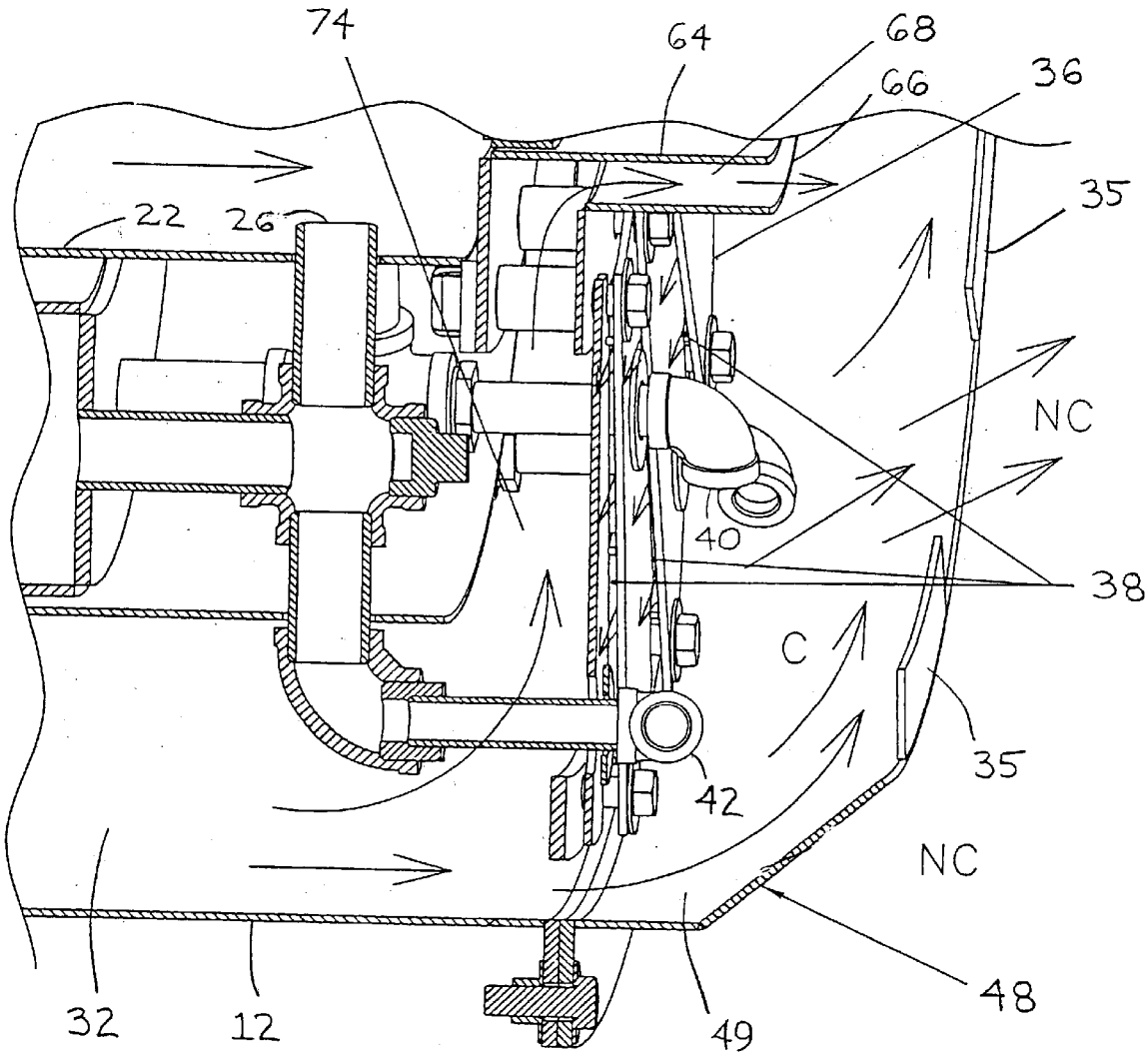
FIG. 3 is an enlarged sectional perspective view of the burner end of the burner assembly shown in FIG. 1 illustrating the inner and outer gas injection nozzles and the different paths along which air from the outer annular channel may flow.

Referring now to FIG. 3, a sectional perspective view of a portion of the burner end shown in FIGS. 1 and 2 is illustrated with arrows representing the flow of combustion air. More particularly, FIG. 3 illustrates the various paths combustion air flowing through outer annular channel 32 and outer air spin vane 34 (See FIG. 2) may take. For example, in a preferred embodiment, a portion of the combustion air that flows through the outer air spin vane flows into area 74 (See also FIG. 2) upstream of radiation plates 36 and thereafter passes through radiation plate gaps 38 into the outer combustion zone. Also in a preferred embodiment, some of the combustion air that flows into area 74 will flow into barrier air passage 68 between control ring 66 and barrier air ring 64. In another preferred embodiment, some of the combustion air that flows through the outer annular channel flows through annular gap 49 (See also FIG. 2) formed by radiation plates 36, housing 12 and converging focusing cone 48. In still another preferred embodiment, annular gap 49 comprises between about 35% and about 55% of the total open area of the burner end of the housing.

Figure 4:
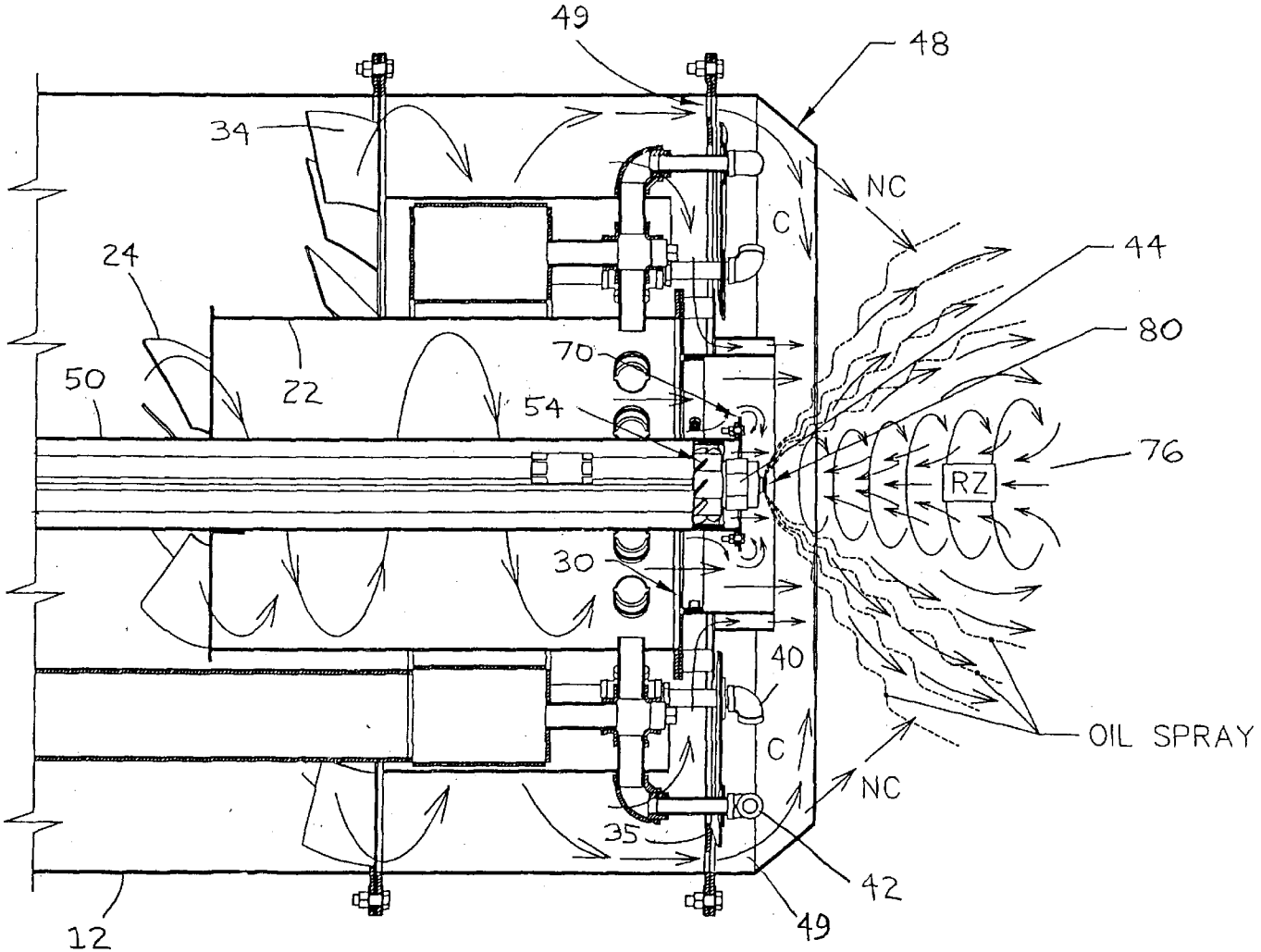
FIG. 4 is an enlarged sectional side view of the burner end of the burner assembly shown in FIG. 1 illustrating the assembly firing on oil with arrows representing the flow of air through the assembly.

Referring now to FIG. 4, a sectional side view of the burner end of the assembly shown in FIG. 1 is illustrated.

More particularly, the burner end is illustrated showing the assembly firing on oil with arrows representing the flow of combustion air. As shown in FIG. 4, atomizing nozzle 44 includes diverging tip or pintle 80 and an internal swirl mixer (not shown). It is also contemplated within the scope of the invention that other types of self-recirculating stabilizing pintle-type nozzles may be used. Pintle 80 effectively deflects the atomized oil spray away from the center of the burner and cooperates with the swirling airflow produced by inner air spin vane 24 to produce a low pressure and self-recirculating stability zone (identified as recirculation zone RZ and described in more detail below) downstream of the atomizer nozzle. Inner air spin vane 24 produces a swirl in the combustion air flow sufficient to achieve a constant recirculating airflow pattern which substantially improves burner stability when firing on any fuel.

FIG. 4 also illustrates recirculation zone RZ which is produced in the area immediately downstream of atomizing air tube 50 and atomizing nozzle 44. As noted above, atomizing air spin vane 54 and the overall configuration of the burner assembly enhances the combustion characteristics developed in the recirculation zone. This enhancement includes producing a wake of low pressure that encourages finer spray 76 to be drawn backwards (upstream) in the area immediately downstream of third castellated ring 70. As shown in FIG. 4, as combustion air flows through annular gap 49, it flows along converging focusing cone 48 and past second castellated ring 35. Second castellated ring 35 then directs the air along one of two general paths. For the combustion air that flows past a non-castellated portion of ring 35, i.e., the portion of the ring having a larger diameter, it will flow toward the outer combustion zone generally along the angle of converging focusing cone 48 (following the arrows labeled NC). See also FIG. 3. For the combustion air that flows past a castellated portion of ring 35, i.e., the portion of the ring having a smaller diameter, it flows toward the center of the burner into the inner combustion zone (following the arrows labeled C). See also FIG. 3.

Figure 5:
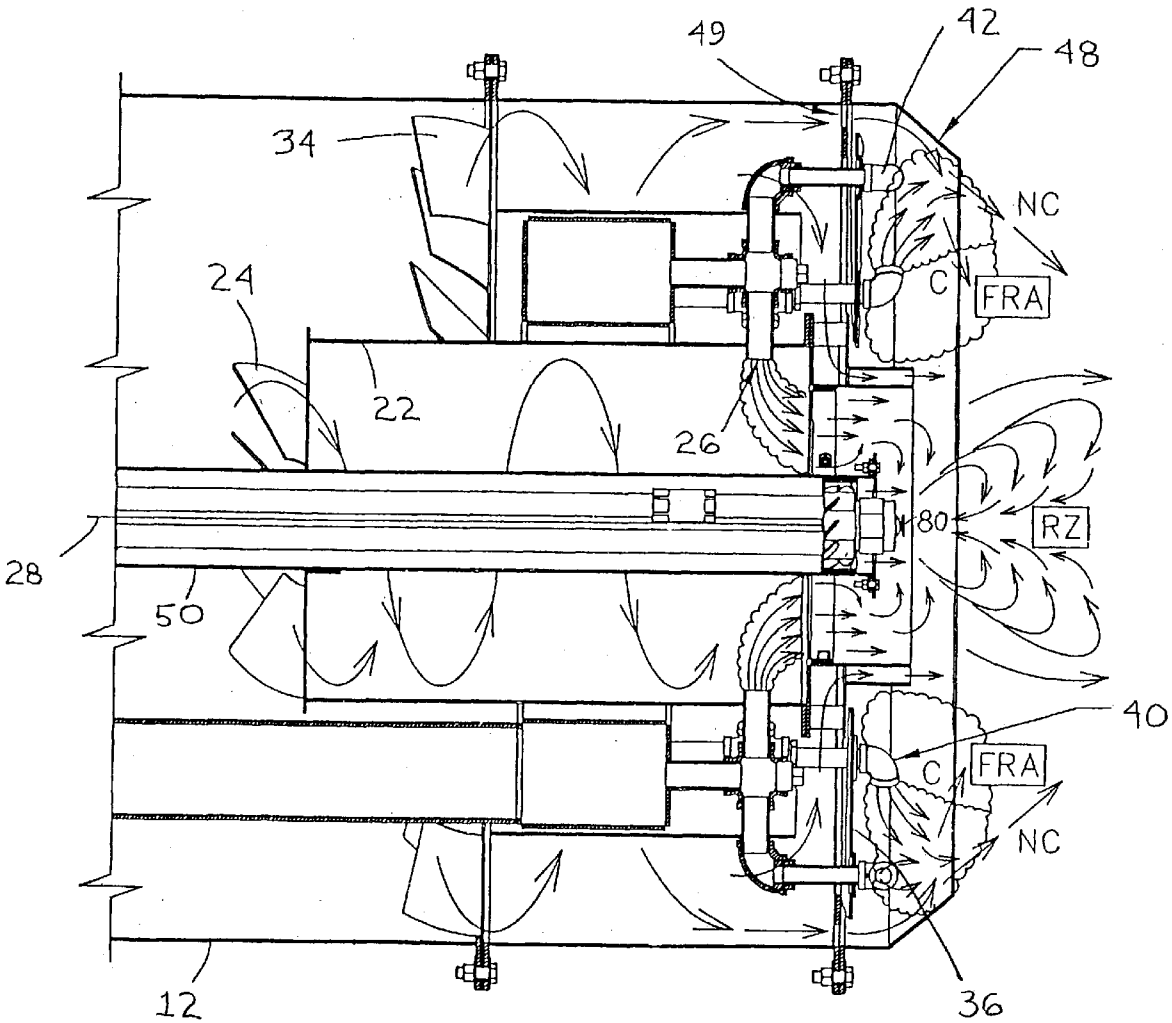
FIG. 5 is an enlarged sectional side view of the burner end of the burner assembly shown in FIG. 1 illustrating the assembly firing on natural gas with arrows representing the flow of air and natural gas through the assembly.

Referring now to FIG. 5, a sectional side view of a preferred embodiment of the burner end of the assembly shown in FIG. 1 is illustrated. More particularly, the burner end is illustrated showing the assembly firing on natural gas with arrows representing the flow of combustion air and natural gas fuel. As shown in FIG. 5, inner gas injection nozzles 26 inject gas into the inner air tube and contribute to the combustion characteristics developed in the flame recirculation zone RZ by firing gas in the wake of pintle 80, thereby avoiding excessive gas flow in recirculation zone RZ which causes excessive flame length and a long flame tail. FIG. 5 also illustrates a second flame recirculation area generally designated as FRA. Flame recirculation area FRA is formed just downstream of radiation plates 36 and around the periphery of recirculation zone RZ. The combustion characteristics developed in flame recirculation area FRA also contribute to the short and narrow flame produced by the burner assembly of the invention.

Referring now to FIG. 6, an end view of the burner assembly shown in FIG. 1 is illustrated. More particularly, FIG. 6 illustrates second castellated ring 35, radiation plate outer gas injection nozzles 42, radiation plate inner gas injection nozzles 40, radiation plates 36, first castellated ring 30, third castellated ring 70, and atomizing nozzle 44. In addition, FIG. 6 illustrates an igniter such as nozzle mix pilot 84 in the area of radiation plates 36. Nozzle mix pilot 84 is adapted to ignite the mixture of fuel and combustion air produced in the burner end of the housing.

Figure 7:
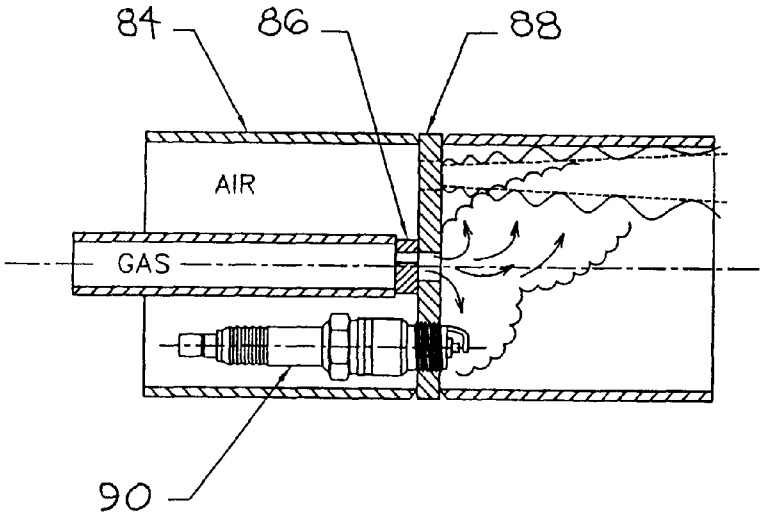
FIG. 7 is a sectional side view of a preferred embodiment of the nozzle mix pilot in accordance with the present invention.

Referring now to FIG. 7, a sectional side view of a preferred embodiment of nozzle mix pilot 84 is illustrated. As shown in FIG. 7, in a preferred embodiment, nozzle mix pilot 84 is of a baffle stabilized design that includes half moon gas orifice 86 located behind baffle plate 88 which is mounted downstream of the atomizing nozzle to improve flame stability. The preferred nozzle mix pilot produces a rich side and a lean side to the baffle such that the flame can burn in some area of the baffle plate where the fuel-to-air ratio is flammable even if the pilot is set quite above or below the stoichiometric ratio. A conventional automotive spark plug 90 is used as an igniter for ease of replacement. However, it is contemplated with the scope of the invention that any suitable igniter could be used to ignite the burner assembly of the invention.

Figure 8:
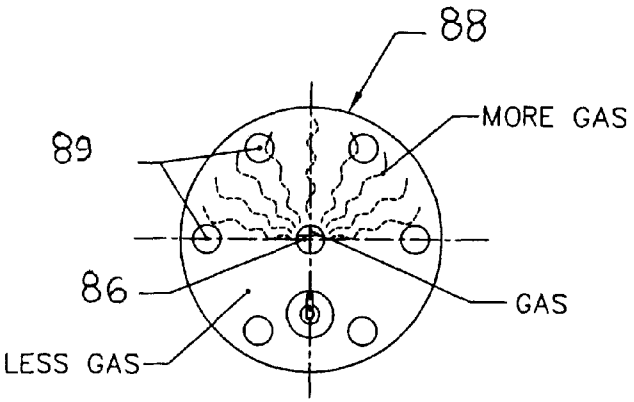
FIG. 8 is an end view of the nozzle mix pilot shown in FIG. 7.

FIG. 8 illustrates an end view of the nozzle mix pilot illustrated in FIG. 7. More particularly, FIG. 8 illustrates a plurality of air holes 89 in baffle plate 88. Air holes 89 are adapted to permit combustion air to flow through baffle plate 88. While FIG. 8 illustrates a baffle plate having six air holes located in a circular arrangement near the perimeter of the baffle plate, it is contemplated within the scope of the invention that less than six or more than six air holes may be located in any suitable arrangement on the baffle plate.

Figure 9:
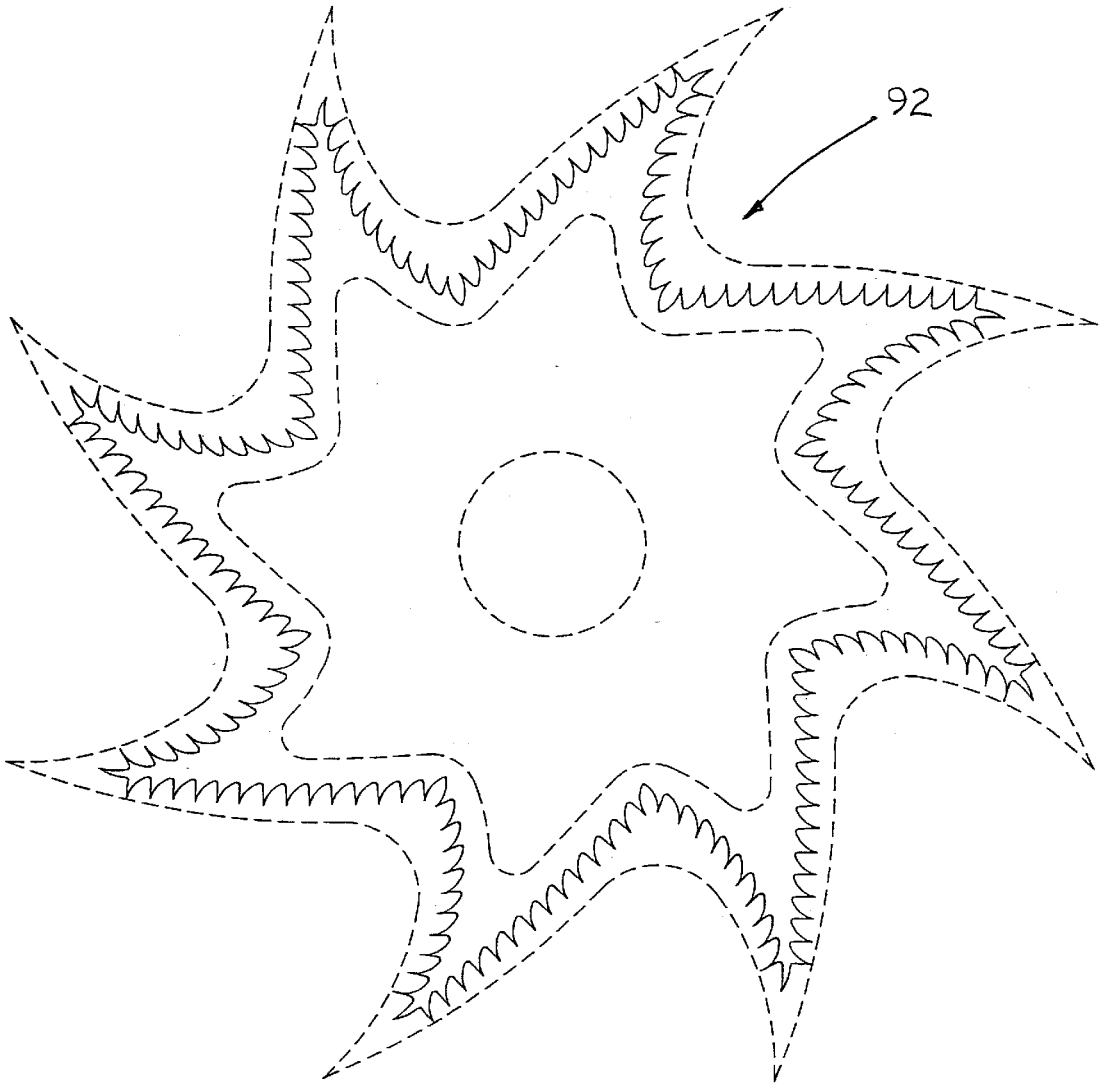
FIG. 9 is an end view of the eight-pointed, curved-star flame configuration produced by the preferred embodiments of the burner assembly of the present invention.

FIG. 9 depicts the 8-pointed, curved-star flame configuration produced by the preferred embodiment of the burner assembly of the invention. The star configuration, generally designated by reference numeral 92, curves in the same general direction as the swirling combustion air in the burner end of the housing. The improved configuration of the flame produced by the burner assembly of the invention eliminates the need to adjust the spin vanes, and in this case, is an 8-pointed, curved star configuration. More particularly, the flame produced by the burner assembly of the invention is both narrow in diameter and short in length. Therefore, the flame is not in close proximity to the inner cylindrical walls of a dryer drum, and it does not extend too far into the drum. Consequently, the flame configuration produced by the burner assembly of the invention does not require excessive drum diameter or length, and it does not require any adjustment of the assembly when the assembly is used with different-sized dryer drums having different-sized combustion spaces. While FIG. 9 depicts an 8-pointed, curved star flame configuration, it is contemplated within the scope of the invention that the flame configuration may include more or less than 8 points. It is understood that the number of points produced in the flame configuration is related to the number of castellations on the second castellated ring.

By way of example, a burner assembly such as burner assembly 10, which is sold by Astec, Inc. under the trademark Whisper Jet-100, that is fired with natural gas at 110 million Btu/hour at 20% excess air produces 400 TPH of asphalt with a visible flame length of 8 feet and a flame diameter of 5 feet. This flame configuration is used with excellent results and requires no air or fuel adjustment in a drum having a combustion section with a diameter of 7 feet and a length of 10 feet. Even with this high combustion intensity, there is no overheating of the drum shell, and low CO emissions are achieved, indicating complete combustion in the short section of the aggregate drum.

Figure 10:
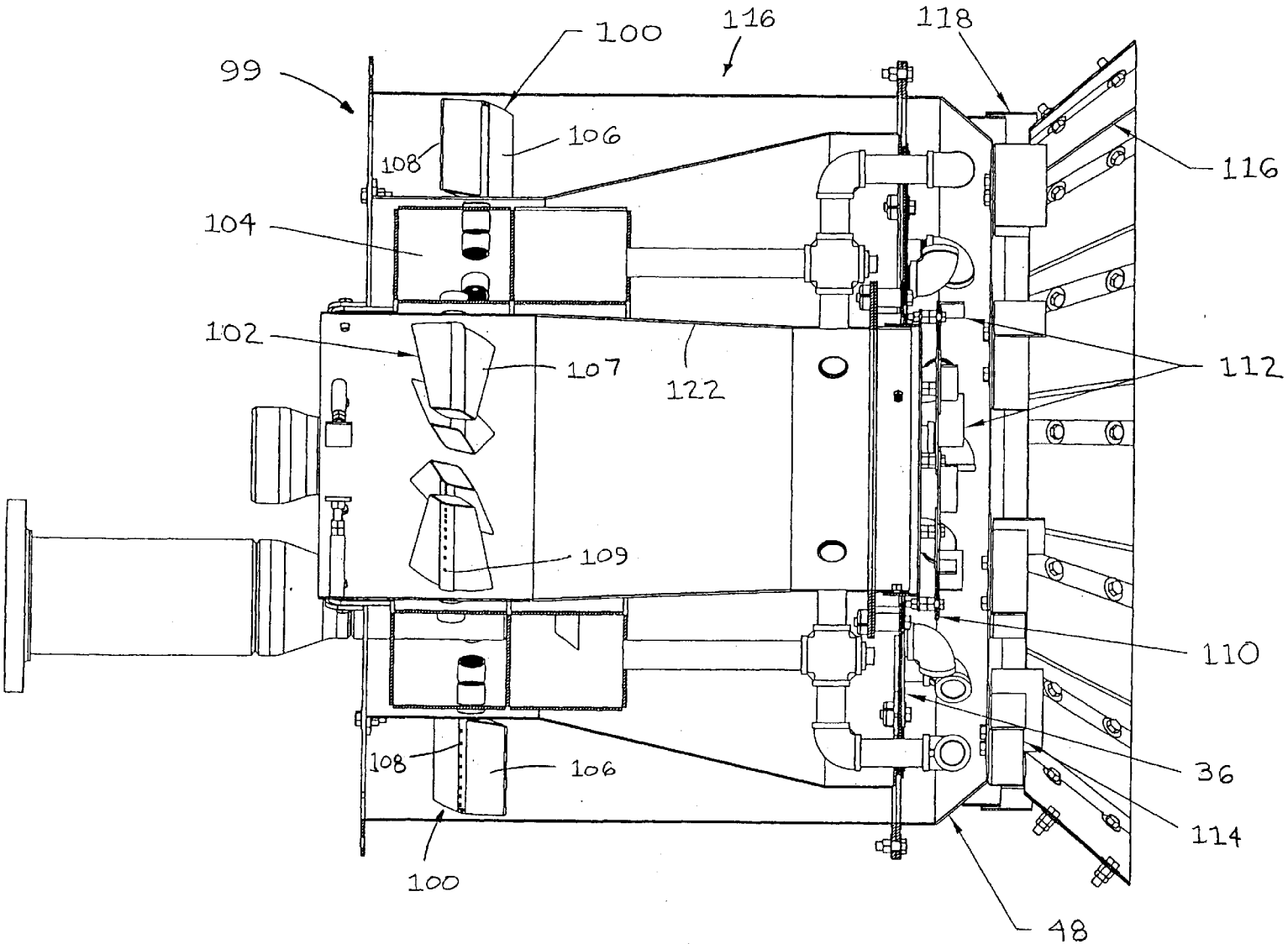
FIG. 10 is a sectional side view of the burner end of an alternative embodiment of the burner assembly of the invention illustrating the supplemental natural gas injection system.
Figure 11:
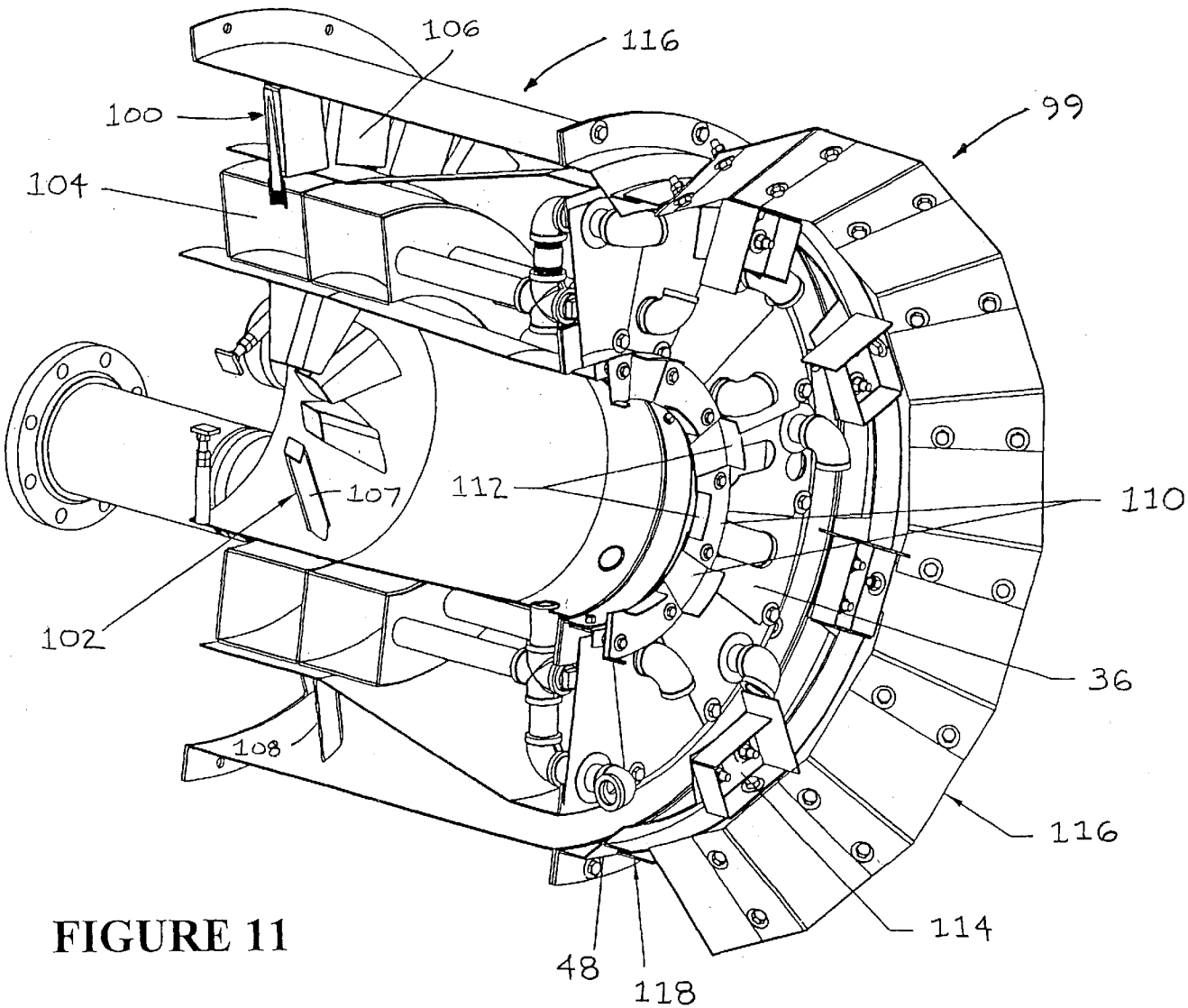
FIG. 11 is a sectional perspective view of the burner end of the alternative embodiment of the burner assembly shown in FIG. 10.

Referring now to FIGS. 10 and 11, an alternative embodiment 99 of the burner assembly of the invention is illustrated. More particularly, FIGS. 10 and 11 illustrate a supplemental natural gas injection system that is mounted in burner end 116 of the housing. The supplemental natural gas injection system is adapted to achieve low NOx emissions by producing a rapid mixing flame with internal recirculation. As shown in FIGS. 10 and 11, the supplemental natural gas injection system includes outer premix natural gas nozzles 100, inner premix natural gas nozzles 102, and a separate supplemental gas manifold 104. Outer premix natural gas nozzles 100 and inner premix natural gas nozzles 102 are adapted to function as both gas nozzles and spin vanes. More particularly, outer premix natural gas nozzles 100 and inner premix natural gas nozzles 102 include a means for mixing combustion air and natural gas. In a preferred embodiment, outer premix natural gas nozzles 100 include outer hollow spin vanes 106 having holes 108, and inner premix natural gas nozzles 102 include inner hollow spin vanes 107 having holes 109 arranged along the length of each vane. Holes 108 and 109 permit natural gas to flow therethrough. Hollow spin vanes 106 and 107 are adapted to evenly and completely mix natural gas and combustion air. While hollow swirl vanes 106 and 107 having holes 108 and 109, respectively, are the preferred means for mixing combustion air and natural gas, it is contemplated that other suitable conventional methods and devices may be used to evenly and completely mix combustion air and natural gas before burning the mixture.

The preferred supplemental natural gas injection system also includes plate 110 that is mounted at the downstream end of inner air tube 122. Plate 110 includes at least one heat fin 112. In addition, at least one outer air castellated flame holder cup 114 that is mounted to the second castellated ring. It is also understood that outer air castellated flame cup holder 114 may be mounted directly to a castellation around the discharge end of the converging focusing cone in the event that a castellated ring is not mounted thereon. Heat fins 112 are adapted to produce stability points for the premix of air and gas. Heat fins 112 also produce a dead area on the backside of the fin which contributes to the recirculation of the air and gas mixture and to the burning of the mixture. Finally, the heat fins become very hot during firing, and thereby further contribute to the stability of the premix of air and gas. Outer air castellated flame holder cups 114 are adapted to provide stability points for the mixture of outer air and gas. In addition, cups 114 produce a dead area on the backside of the cup which contributes to the recirculation of the air and gas mixture and to the burning of the mixture. Finally, cups 114 become very hot during firing, and thereby further contribute to the stability of the premix of air and gas. In addition, the preferred supplemental natural gas injection system includes diverging conical discharge section 116 located downstream from converging focusing cone 48. The preferred supplemental natural gas injection system also includes adjustable opening band 118 mounted between the diverging conical discharge section and the converging focusing cone. Diverging conical discharge section 116 is adapted to reduce CO emissions. Adjustable opening band 118 may be adjusted to allow more or less induced recirculation of the gases into the diverging conical discharge section in order to increase or decrease the temperature therein. It has been found to be beneficial to have a slightly richer inner air section to increase the stability of the burner. It is contemplated within the scope of the invention, however, that additional suitable conventional means may be used to stabilize the lean flame.

According to the alternative embodiment illustrated by FIGS. 10 and 11, ultra-low NOx emissions in the range of less than 20 PPM NOx referenced to 3% oxygen can be achieved. In addition, CO emissions may be reduced to less than 200 PPM CO referenced to 3% oxygen.

In operation, the several advantages of the burner assembly of the invention are achieved. For example, a short and narrow, stable, 8-pointed, curved star flame configuration is produced by the burner assembly of the invention. The improved flame configuration reduces the amount of combustion space required to heat and dry aggregate materials for the production of hot mix asphalt. In addition, the spacing and configuration of the spin vanes, the castellated rings, and the gas injection nozzles results in a more complete and even mix of combustion air, natural gas and/or oil. The spin vanes are fixed because adjustment of the flame configuration is not required, even when using the burner assembly with a variety of different-sized dryer drums. As a result, costly and complicated adjustable spin vanes are eliminated. In addition, the converging focusing cone section reduces the temperature of the dryer drum breech plate. Ultra-low NOx emissions may be achieved using the supplemental natural gas injection system of the preferred embodiment. Further, the standard natural gas injection system is still functional in the event that the supplemental natural gas injection system fails.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A burner assembly comprising:

(a) a housing having an air inlet and a burner end;

(b) an impeller mounted in the housing and in communication with the air inlet, which impeller is adapted for directing air towards the burner end of the housing;

(c) an inner air tube that is mounted in the burner end of the housing so as to define an inner combustion zone and an outer combustion zone;

(d) a fixed inner air spin vane that is mounted on the inner air tube so as to direct some of the air from the impeller into the inner combustion zone;

(e) an inner gas injection nozzle mounted on the inner air tube so as to direct gaseous fuel into the inner combustion zone;

(f) a first castellated ring that is mounted around the periphery of the inner air tube;

(g) a fixed outer air spin vane that is mounted in the burner end of the housing so as to direct some of the air from the impeller into the outer combustion zone;

(h) a plurality of outer gas injection nozzles that are mounted in the burner end of the housing so as to direct gaseous fuel into the outer combustion zone;

(i) a second castellated ring that is mounted around the periphery of the burner end of the housing;

(j) a plurality of radiation plates that are mounted in the burner end of the housing adjacent to the outer combustion zone;

(k) an igniter that is mounted in the burner end of the housing.

2. The burner assembly of claim 1 which includes a gas manifold that is in fluid communication with the inner gas injection nozzle and the outer gas injection nozzles, said manifold being mounted downstream of the outer spin vane so that the gas manifold is cooled by some of the air from the impeller.

3. The burner assembly of claim 1 which includes a plurality of inner gas injection nozzles that are mounted around the inner air tube so as to direct gaseous fuel into the inner air tube.

4. The burner assembly of claim 1 wherein:

(a) the inner air tube has a longitudinal axis; and (b) the plurality of outer gas injection nozzles includes:

(i) a plurality of radiation plate inner gas injection nozzles that are mounted through the radiation plates around the atomizing nozzle so as to direct gaseous fuel toward the outer combustion zone; and (ii) a plurality of radiation plate outer gas injection nozzles that are mounted through the radiation plates around the atomizing nozzle so as to direct gaseous fuel in the general direction of the air directed by the outer air spin vane.

5. The burner assembly of claim 1 which includes a converging focusing cone mounted on the burner end of the housing around the periphery of the outer combustion zone, said second castellated ring being mounted on the converging focusing cone.

6. The assembly of claim 5 wherein an annular gap is provided between the radiation plates, the housing, and the converging focusing cone, said annular gap being between about 35% and about 55% of the total open area of the burner end of the housing.

7. The burner assembly of claim 1 which includes:

(l) an atomizing air tube that is mounted within the housing, said tube having an inlet end and an outlet end, said inlet end being located downstream of the impeller and said outlet end being located adjacent to the inner combustion zone;

(m) an atomizing nozzle that is mounted on the outlet end of the atomizing air tube;

(n) a liquid fuel supply tube that is mounted within the atomizing air tube so as to convey liquid fuel to the atomizing nozzle;

(o) a third castellated ring that is mounted around the periphery of the outlet end of the atomizing air tube;

(p) a compressed air supply tube that is mounted within the atomizing air tube so as to convey compressed air to the atomizing nozzle.

8. The burner assembly of claim 7 which includes an atomizing air spin vane that is mounted in the burner end of the housing so as to direct some of the air from the impeller into the inner combustion zone.

9. The burner assembly of claim 7 which includes a damper that is located within the housing downstream of the inlet end of the atomizing air tube.

10. The burner assembly of claim 7 wherein the atomizing nozzle includes a half moon gas orifice and a baffle plate mounted downstream of the atomizing nozzle.

11. The assembly of claim 7 which includes:

a. means for conveying compressed air to the atomizing nozzle via the compressed air supply tube at a pressure of between about 55 psi and about 75 psi; and b. means for conveying oil to the atomizing nozzle via the liquid oil supply tube at a pressure of between about 55 psi and about 75 psi.

12. The burner assembly of claim 7 which includes a barrier air ring that is mounted in the burner end of the housing so as to prevent low fire oil spray from being drawn into the radiation plates.

13. The burner assembly of claim 7 which includes a barrier air ring and a control ring that are mounted in the burner end of the housing so as to provide a barrier air passage therebetween.

14. The assembly of claim 13 wherein the barrier air passage is between about 15% and about 22% of the total area of the burner end of the housing.

15. The assembly of claim 13 wherein the area between the third castellated ring and the barrier air ring is between about 13% and about 22% of the total open area of the burner end of the housing.

16. The burner assembly of claim 1 wherein a gap is provided between each of the plurality of radiation plates so that some of the air from the impeller may flow between each of the radiation plates.

17. The assembly of claim 16 wherein the distance between the radiation plates is between about 0.125 and about 0.1875 inches.

18. The assembly of claim 16 wherein the total area of the radiation plate gaps is between about 5% and about 15% of the total area of the burner end of the housing.

19. The burner assembly of claim 1 wherein a supplemental natural gas injection system is mounted in the burner end of the housing, said system comprising:

a. a premix natural gas nozzle;

b. a natural gas manifold in fluid communication with the premix natural gas nozzle;

c. a means for mixing combustion air and natural gas;

d. a plate that is mounted on the inner air tube, said plate having a heat fin;

e. an outer air castellated flame holder cup that is mounted on the converging focusing cone;

e. a diverging conical discharge section located downstream from the converging focusing cone;

f. an adjustable opening band that is mounted between the diverging conical discharge section and the converging focusing cone.

20. The assembly of claim 19 wherein the means for mixing combustion air and natural gas comprises a plurality of hollow spin vanes that are mounted in the burner end of the housing.

* * * * *